US006902077B1

(12) United States Patent
Tack et al.

(10) Patent No.: US 6,902,077 B1
(45) Date of Patent: Jun. 7, 2005

(54) CONTAINER

(75) Inventors: Joris Jozef Gustaaf Tack, Rome (IT); Michela Ratti, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/831,004

(22) PCT Filed: Nov. 4, 1999

(86) PCT No.: PCT/US99/26246

§ 371 (c)(1),
(2), (4) Date: May 3, 2001

(87) PCT Pub. No.: WO00/27268

PCT Pub. Date: May 18, 2000

(30) Foreign Application Priority Data

Nov. 9, 1998 (EP) ..... 98870244

(51) Int. Cl.[7] ..... B65D 43/18

(52) U.S. Cl. ..... 220/259.1; 220/254.1; 206/449

(58) Field of Search ..... 220/259, 835, 220/254, 827, 833, 836, 831, 38, 326, 792, 220/795, 790, 829, 830, 324, 254.1–254.5, 220/849, 345.6, 803, 804, 387, 259.1, 354.6; 211/63; 206/494, 205, 498, 449; B65D 43/16, B65D 43/14

(56) References Cited

U.S. PATENT DOCUMENTS 1,986,057 A * 1/1935 Hackworth ..... 220/849
2,033,295 A * 3/1936 Parkin ..... 220/849
3,841,466 A * 10/1974 Hoffman et al. ..... 206/205
3,994,417 A * 11/1976 Boedecker ..... 221/48
4,208,118 A * 6/1980 Urano et al. ..... 396/536
4,298,204 A * 11/1981 Jinkins ..... 277/641
4,649,453 A * 3/1987 Iwasawa ..... 360/137
4,739,900 A * 4/1988 Borst ..... 220/339
4,790,436 A * 12/1988 Nakamura ..... 206/449

(Continued)

FOREIGN PATENT DOCUMENTS

EP 0 748 748 A1 12/1996

(Continued)

OTHER PUBLICATIONS

Bando et al., US 2002/0017522A1, Feb. 2002.*

*Primary Examiner*—Lien M. Ngo
(74) *Attorney, Agent, or Firm*—Matthew P. Fitzpatrick; Ian S. Robinson; Ken K. Patel

(57) ABSTRACT

A container for wetted wipes, comprising a container body with at least one opening, a stationary cover being fitted on, or integrated to said container body, said stationary cover comprising at least one dispensing opening through which the container contents is removed, a movable lid which is movably attached to said stationary cover, or is an integral movable part of the stationary cover, so as to reversibly close said dispensing opening, the container being characterized in that a gas-proof means is located between said stationary cover and said movable lid, for providing a gas-tight barrier between the inside and the outside of the container when the movable lid is in the closed position. Preferably, the tub also comprises a spring element and a releasable lock for automatic opening of the movable lid.

12 Claims, 4 Drawing Sheets

U.S. PATENT DOCUMENTS 4,971,774 A * 11/1990 Schwanke et al. ..... 422/310
5,065,885 A * 11/1991 Scaroni ..... 220/326
5,526,953 A * 6/1996 Chieng ..... 220/4.23
5,573,132 A * 11/1996 Kanfer et al. ..... 220/254
5,699,912 A * 12/1997 Ishikawa et al. ..... 206/494
6,065,626 A * 5/2000 Huang et al. ..... 220/254.5
6,192,895 B1 2/2001 Yuhara et al.
6,206,221 B1 * 3/2001 Bando et al. ..... 220/254
6,220,470 B1 * 4/2001 McHenry et al. ..... 220/254.4

FOREIGN PATENT DOCUMENTS

EP 0 832 823 A1 4/1998
WO WO 97/25106 7/1997
WO WO 97/25404 7/1997

* cited by examiner

CONTAINER

FIELD OF THE INVENTION

The present invention relates to a container with an automatic opening, in particular to a container for wetted wipes.

BACKGROUND OF THE INVENTION

Containers for wetted wipes are representative of the various containers for consumer products to which the present invention can apply; such containers typically comprise, a body of the container constructed so that it can contain a stack or a roll of wetted wipes, and a closing device adapted to fit on the body to cover its opening. Such a closing device comprises a stationary cover directly fitting on the upper opening of the body and a movable lid having its base end movably attached to one side end of an opening formed in a central zone of the stationary cover, and through which the wetted wipes will be picked out one by one. Usually, the dispensing opening is located in the central part of the stationary cover. A spring means is further provided as a link between the stationary cover and the movable lid, which is charged with an elastic energy when the lid is in the closed position. Finally, a releasable locking mechanism allows to releasably secure the movable lid in the closed position together with the stationary cover. When the lock is released, the elastic energy contained in the spring element forces the lid in the open position automatically.

The following references are directed to containers for wetted wipes including such a closing/dispensing device: European Patent Application EP-O-748 748 A 1, Unicharm Corp., published 18 Dec. 1996: teaches a container for wetted wipes comprising a container body, a movable lid which is hinged to a stationary cover.

An rubber-like strip is provided, combined to a releasable lock for automatic opening of the package; European patent application EP-O-832823 A1, to Beiersdorf. It discloses a container which comprises a base onto which a stationary cover is fitted. The stationary cover comprises an opening which is opposite to the bottom side of the tub. The opening is open/closed by a hinged lid, which is automatically opened by action of a spring element located between the movable lid and the stationary cover. Cover and lid are secured in closed position by means of a lock. The lock comprises a protrusion of the movable lid which fits into a recess of the stationary cover. The lock is released by pushing on a recessed portion of the cover.

A main problem with the above mentioned inventions is that in some cases, the container is to be filled with wetted wipes which are moistened with a lotion, for example a disinfectant lotion, comprising volatile chemicals and/or organic solvents, such as alcohols. Then, there is a risk that these chemicals be released in the atmosphere, and thus, that the wipes dry out after a short period of storage, thus losing their specific properties, for example their disinfectant properties.

It is therefore one main object of the present invention to provide the user with a container for wetted wipes which is easy to handle, especially when only one hand is available to manipulate the package and its contents, and which has gas-tight properties which prevent evaporation of the lotion impregnated in the wipes during storage.

It is another optional object of the present invention to provide a container which does not contain overhang nor sharp edges near the dispensing portion of the container.

It is a further optional object of the present invention to provide a container in which the spring open mechanism is not accessible from the outside of the container, especially at the time the container is being refilled.

SUMMARY OF THE INVENTION

The present invention is directed to a container for wetted wipes, comprising a container body with at least one opening, a stationary cover being fitted on, or integrated to said container body, said stationary cover comprising at least one dispensing opening through which the container contents is removed, a movable lid which is movably attached to said stationary cover, or is an integral movable part of the stationary cover, so as to reversibly close said dispensing opening, the container being characterized in that a gas-proof means is located between said stationary cover and said movable lid, for providing a gas-tight barrier between the inside and the outside of the container when the movable lid is in the closed position.

Preferably, a spring element is located between said stationary cover and said movable lid, and is charged with an elastic energy when the movable lid is in closed position and releasable locking mechanism is located between the stationary cover and the movable lid for releasably securing the movable lid in the closed position onto the stationary cover. Furthermore and preferably, the spring element is a metallic single or multiple winding coil spring with two elongated ends, and the gas-tight means is an annular rubber-based, or flow-in silicon elastomer gasket seal which is located along the periphery of the stationary cover's dispensing opening. More preferably, said gasket seal is compressed between the movable lid and the cover when the lid is in the closed position.

BRIEF DESCRIPTION OF THE DRAWINGS

The invention will now be explained in detail with reference to the accompanying drawings, in which.

DETAILED DESCRIPTION OF THE INVENTION

Figure 1:
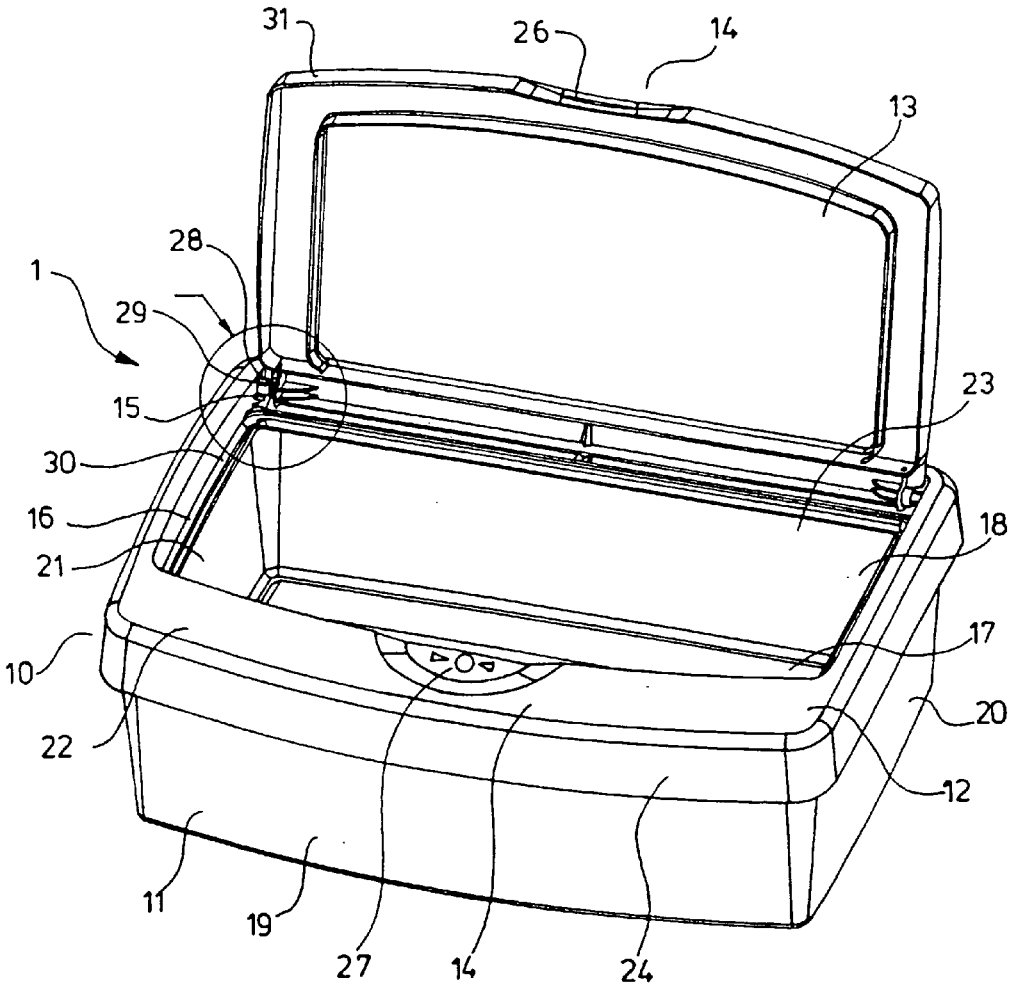
FIG. 1 is a perspective view of the container with movable lid in the open position, showing the dispensing opening surrounded by the gasket seal.
Figure 3:
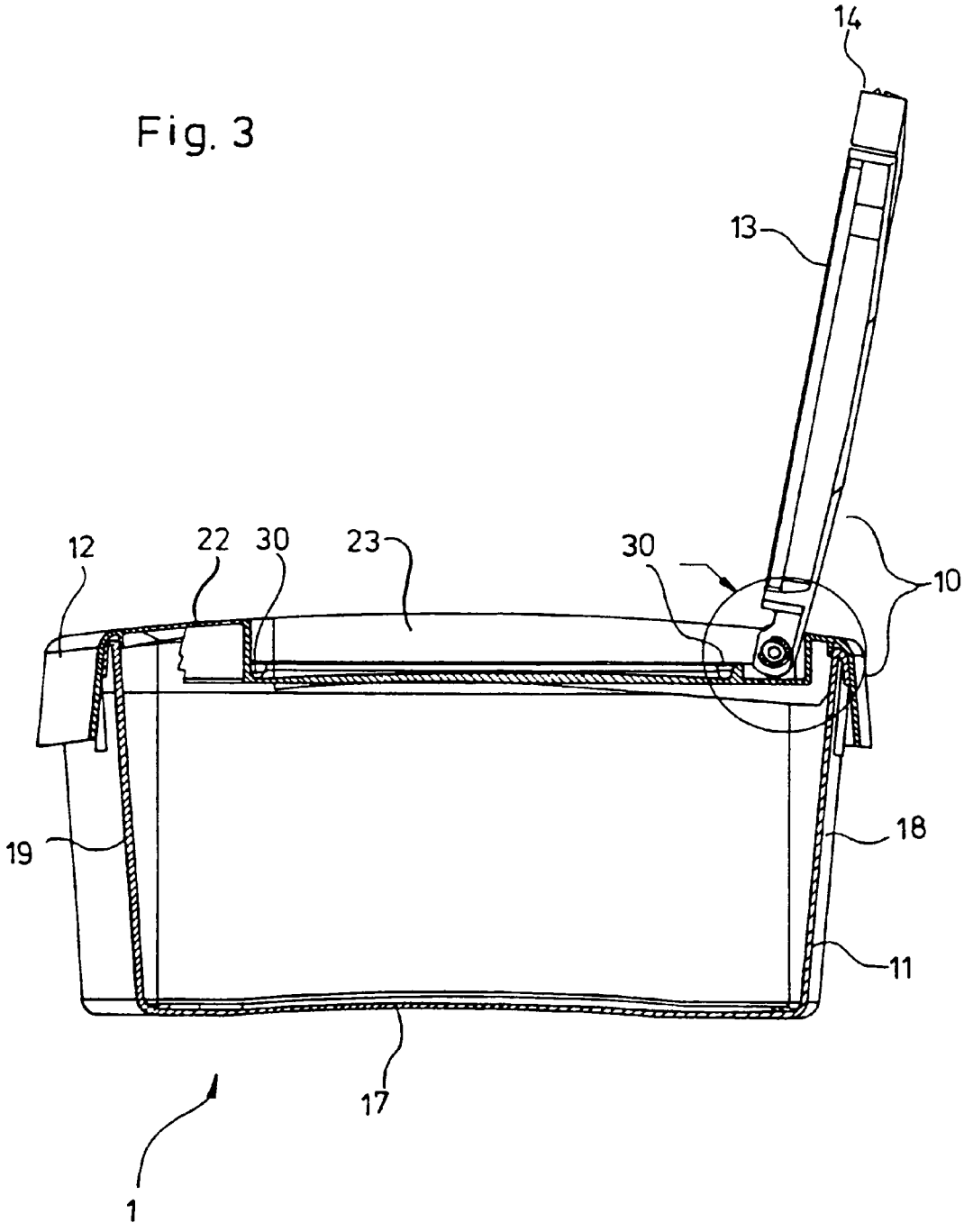
FIG. 3 is a profile view of the tub in open position showing how the movable lid is hinged to the stationary cover.

Referring to FIGS. 1 and 3, a container (1) is made of a closing device (10) which fits onto a container body (11), or is a part of the container body (11). The container body (11) can have any shape suitable for containing a stack or a roll of wipes, preferably wetted wipes, and more preferably wipes wetted with a disinfectant lotion. Said shape can be either cylindrical, polygonal, but is preferably parallelepipedic. The closing device (10) comprises a stationary cover (12) and a movable lid (13) both made of a suitable synthetic resin material. The container (1) further comprises a releasable locking mechanism (14) which holds said container in the closed position, and a spring element (15) which allows automatic opening of the movable lid (13) relatively to the rest of the container, thus giving access to the container contents. The container (1) also comprises a gas-tight means (16) which prevents drying out of the wipes during storage. Preferably, the wipes are contained inside a flexible pouch which is placed into the container body (11). In this way, the container (1) is made re-usable, and the refill operation is merely achieved by placing new pouches of wipes into the same container (1). The pouch is preferably made out of a laminate material with good gas-tight properties, so as to prevent drying out of the wipes contained inside. The pouch shall also be of a material which is chemically resistant to organic solvents or oils, especially solvents which are used for cleaning purposes, either separately or in a combination.

The contents of the container can be any kind of consumer product which comprises a volatile component, but is preferably an at least partially paper based product, more preferably wetted wipes for body care purposes, or for household cleaning purposes. Such wipes are for example made of a base out of wood-pulp (i.e. cellulose) together with a synthetic additive, for example a polyester resin. Alternatively, the wipes are made out of a synthetic resin exclusively, such as for example polypropylene or polyester non-woven fabric. An adhesive can also be provided to link the different components of the wipe, for example in case a cellulose base is mixed with a synthetic material.

Such wipes can be used in any form, for example they can be dry, or wet, and can be directed to body care or household purposes. In a preferred embodiment of the present embodiment of the present invention, the container contains wipes moistened with a disinfectant and/or cleaning lotion, which is to be used for household cleaning purposes. While any composition suitable for achieving cleaning purposes may be used, the disinfectant lotion is preferably an alcohol-based liquid, which further contains ingredients such as surfactants, perfumes, colorants. More preferably, the lotion contains water, hydrogen peroxide, C12-14 amine oxide, thanol, thymol, citric acid, di-ethylen glycol mono-butyl ether, propylene glycol butyl ether, polypropylene glycol mono-butyl ether, butylated hydroxyl toluene, salicylic acid, geraniol, and at least one perfume component. Such disinfectant wipes are to be used for hard-surface cleaning usage, for example for cleaning furniture or appliances. Other examples of lotions which can be used for wetting the wipes are also disclosed in the following applications: WO 9725404, or WO 9725106 both filed 8 Jan. 1997 by Procter & Gamble.

In a first and preferred embodiment of the present invention, the container body (11) comprises a bottom wall (17), back (18), front (19), right (20) and left (21) side walls defining a substantially parallelepipedic hollow receptacle, the container body's top side being wide open so as to define an upper opening. A flange extends along an outer peripheral edge of said opening onto which the closing device (10) is fitted. The container body (11) is made from any suitable thermoplastic material such as for example polyethylene or polypropylene resins.

In another embodiment of the present invention, the container body (11) comprises back (18), front (19), right (20) and left (21) side walls, the stationary cover (12) is integrally molded with said container body (11), such as to form its top wall, and the bottom wall of said container is open, preferably wide open, so as to constitute a refill opening. A removable, and preferably flexible cover is fitted onto said refill opening.

In a third embodiment of the present invention, the stationary cover (12) is integrally molded as a part of the container body (11). Both parts are linked by a living hinge, which is preferably located at the rear side of the container. In this case, the bottom side of the container is preferably closed and integral with the side walls of said container body (11).

Optionally but preferably in any of the three preceding embodiments of the present invention, the base surface of the container is greater than its top surface, so as to increase the stability of said container (1). Moreover, the bottom side of the container body (11) or the removable cover comprise at least one non-skid portion which is made out of a material whose flexibility and Young modulus are such as to prevent sliding of the container when it is standing on a support such as table or a shelf, and being manipulated by the user. In the first of the two preceding embodiments of the present invention, the non-skid portion is preferably achieved by at least four suction naps or rubber-like plots. More preferably, these naps or plots are not separate elements inserted nor glued at the surface of the container body (11), but they are integrally molded with the bottom side of the container body (11) so that they cannot be separated from the rest of the container. The reason for this is to prevent that young children could accidentally detach them and try to ingest them, thus risking suffocation. Any known process shall be used to manufacture the container body (11), such as for example injection molding process. In the case non-skid suction naps or rubber-like plugs are present at the bottom side of the container body (11), a multi-injection molding process is preferred.

As shown in FIGS. 1 to 4, the stationary cover (12) is a plate-like element which is fitted on, or is integrally molded with the container body (11). As previously described, in the preferred embodiment of the present invention, the stationary cover (12) is fitted onto the top opening of the container body (11). Said stationary cover (12) comprises firstly, a top side (22) with at least one dispensing opening (23). Said stationary cover (12) further comprises peripheral walls (24) which are integrally molded with said top side, and extend downwardly. In a preferred embodiment of the present invention, the container is substantially parallelepipedic, and thus, the stationary cover (12) comprises four peripheral walls, namely front, back, left and right peripheral walls. These peripheral walls are constructed to fit with the peripheral flange of the container body (11) in such a way that the assembly features excellent gas-tight properties. Optionally, an additional gas-tight means is provided between the closing device (10) and the container body (11) which can take the form of a rubber-like seal which is located along the periphery of the tub between th se two parts.

At least one of the walls of the stationary cover (12), preferably at least its front wall, comprises a protruding portion (25), for example a catch, which cooperates with a recess or another protrusion (26) of the movable lid (13), so as to form a releasable locking mechanism (14) when the movable lid (13) is mounted onto the stationary cover (12).

The stationary cover (12) comprises one or more, preferably one, dispensing opening (23) at its top part. Said dispensing opening (23) can be a separate part which is added to the stationary cover (12), but is preferably an integral portion of the stationary cover (12).

In a first and preferred embodiment of the present invention, said dispensing opening (23) is a wide open portion of the stationary cover (12). Its surface is comprised within the range of 5 to 95% of the surface of the stationary cover's top side, preferably within the range of 20 to 75% of the surface of the stationary cover's top side. This type of opening is particularly efficient when the contents is sheet-like material, for example wetted wipes, which are not interleaved, and thus are removed one by one without interaction between them.

In a second embodiment of the present invention, the dispensing opening (23) is a restricted opening of the stationary cover's top side. This type of opening is particularly efficient for one by one removal of sheet-like material, for example wetted wipes, which are packed under the form of a stack in an interfolded zigzag manner, so referred to in the art as pop-up dispensing. As a wipe is dispensed, the leading edge of said wipe furls onto the edges of one portion of the opening, then as the next wipe is dispensed, its leading edge furls onto the edges of the opposite portion of the opening, and this continues in an alternating manner as first one and then a next wipe is dispensed. This arises because the wipes are folded in an alternating zigzag pattern whereby the wipes are pulled up from first the front of the tub and then the rear, alternately.

In both of the two preceding embodiments of the dispensing opening (23), especially in case the contents is sheet-like material such as wipes, an alternative manner of packing is to make a continuous roll of wipes. Preferably, the roll comprises transverse precuts at intervals along its length, such as to facilitate tearing and dispensing of the wipes one by one from the roll. In this case, one edge portion of the dispensing opening (23) preferably comprises a means, for example, a series of teeth or conic-shaped sharp profiles which is to be used to facilitate the blocking of the wipe in its desired length and to cut the dispensed wipe from the roll.

The stationary cover (12) further features at least one elastically deformable portion which is to be used as a push-button means (27) in cooperation with the releasable locking mechanism (14) as will be described later in the present description. Said push-button (27) is located near to the protrusion (25) of the stationary cover (12), preferably between the front edge of the stationary cover (12) and the front part of the dispensing opening (23).

In a first and preferred embodiment of this invention, said elastically deformable portion (27) is an integral portion of the stationary cover (12). For example, it can be a portion of the stationary cover (12) whose thickness is reduced, so as to improve its flexibility. Preferably, it is located in a recessed portion of the stationary cover (12).

In a second embodiment, the deformable portion (27) is a separate element which is fitted, for example clipped, onto the stationary cover (12), in such a way that it can be elastically displaced. For example, it can be a bascule push-button (27), onto which the protrusion of the stationary cover (12) is connected.

At least one attaching means is also provided onto the stationary cover (12), preferably at its rear end, more preferably near to one of the hinge elements. Said attaching means is for attaching one portion of the spring element (15). Preferably, said attaching means is a locating seat with the shape of a recess provided with a hook-like element or a small groove (30) which catches one end of the spring element (15). More preferably, said locating seat is covered so that access to the middle part of the spring element (15) is not possible.

Figure 5:
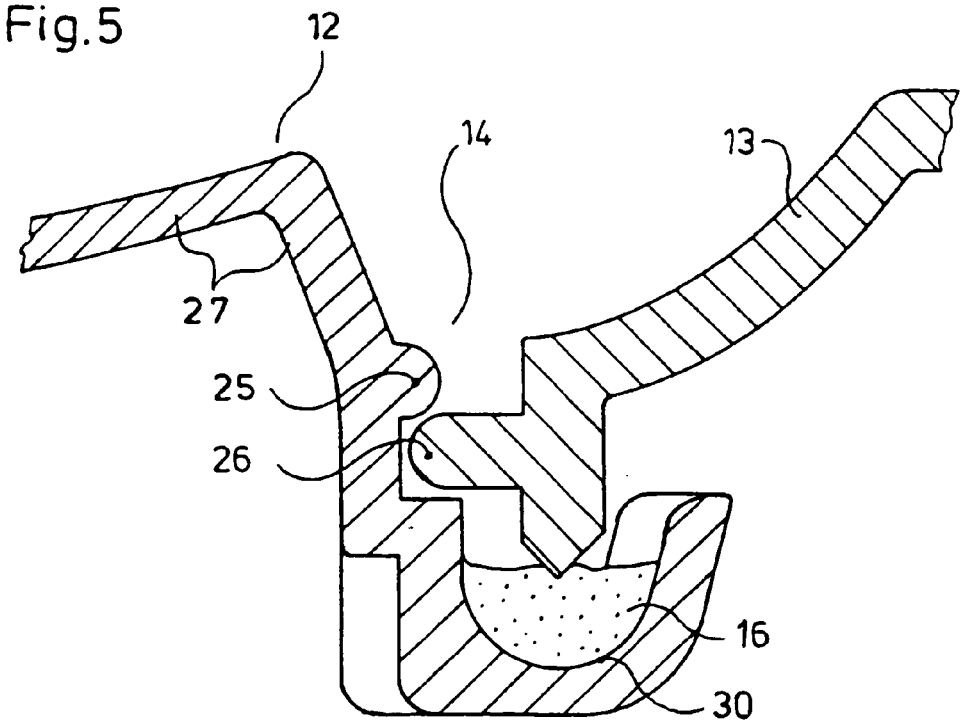
FIG. 5 is an enlarged profile view of the front portions of the stationary cover and movable lid showing the locking mechanism in its closed position and the gasket seal.

Optionally but preferably, the stationary cover (12) features a groove (30) which is located all along the periphery of the dispensing opening (23). The gas-tight means (16) is to be located into this groove (30), and the peripheral walls (31) of the movable lid are fitted inside this groove (30) when said movable lid (13) is in the closed position, as shown in FIG. 5.

Figure 2:
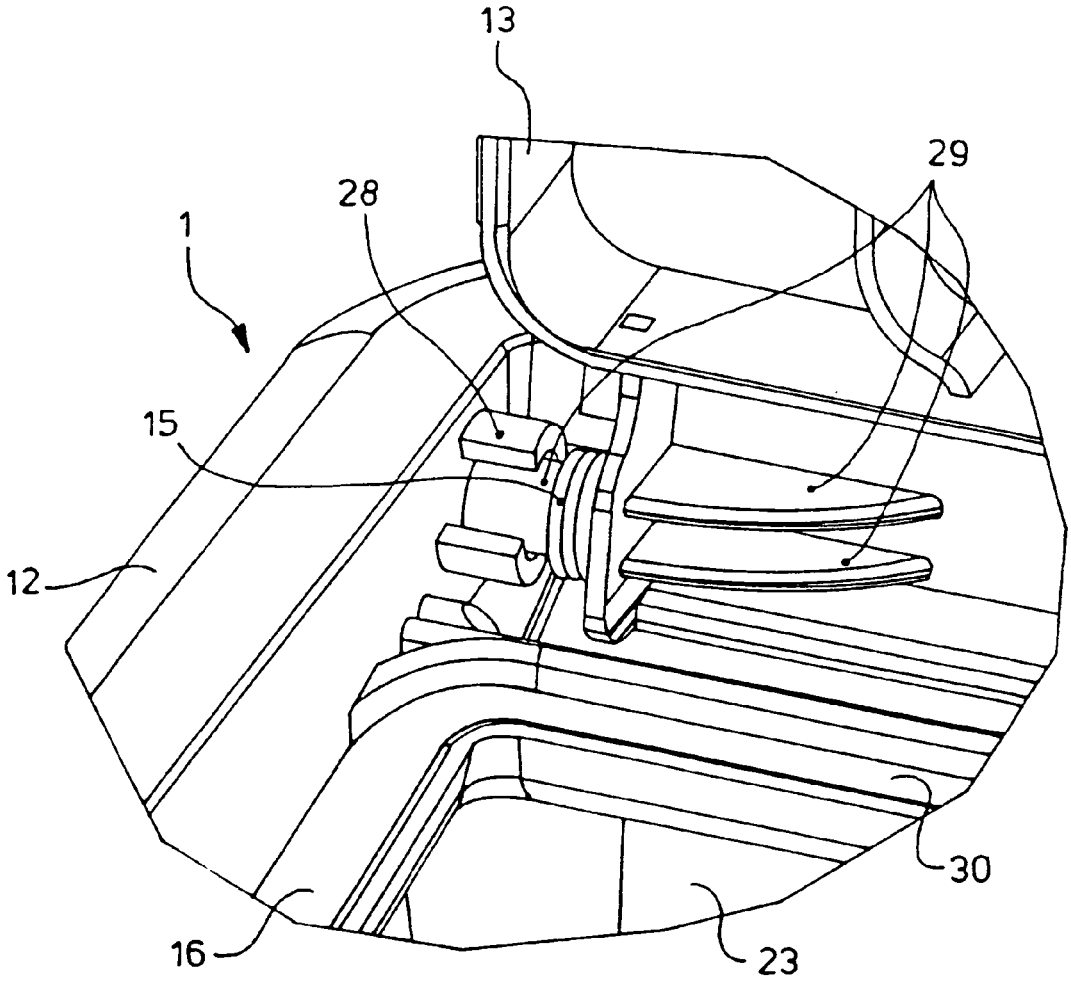
FIG. 2 is an enlarged perspective view showing a preferred embodiment of the hinge linking the movable lid and the stationary cover with integrated spring element.

As shown in FIGS. 1 and 2, the movable lid (13) is a plate-like element, with a polygonal or rounded shape, preferably rectangular. It comprises a top side with peripheral walls (31), namely, front, back, left and right walls extending downwardly from said top side. Its dimensions are such that it completely overlaps the dispensing opening (23) of the stationary cover (12) when the container is in the closed position.

In a first embodiment of the present invention, the movable lid (13) is an integral part of the stationary cover (12), and is movably connected to said stationary cover (12) through a living hinge. Said living hinge is preferably located at the rear side of said stationary cover (12) and movable lid (13).

Figure 4:
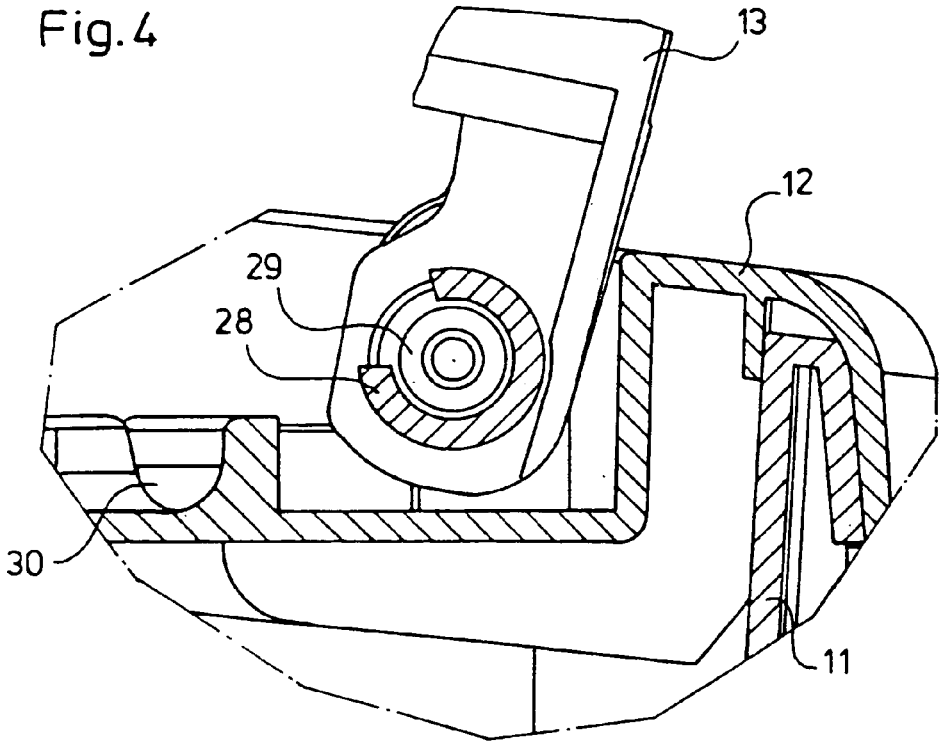
FIG. 4 is an enlarged profile view showing the hinge connecting the movable lid and the stationary cover.

In a second and preferred embodiment of the present invention, the movable lid (13) is a separate element from the stationary cover (12). At least two hinge elements (28) of the stationary cover are located in said stationary cover's top side, preferably in its rear portion, which cooperate with corresponding hinge elements (29) of the movable lid, so that said movable lid (13) can be movably attached to the stationary cover (12). Preferably, said hinge elements (28) of the stationary cover take the form of two circular recesses into which pin elements of the movable lid (13) are fitted, as is shown in FIGS. 2 and 4.

At least one of the movable lids outside peripheral walls, preferably at least its front wall, comprises a portion which fits with the protrusion (25) of the stationary cover (12) so as to create a releasable locking mechanism (14) when the lid is mounted onto said stationary cover (12). Said portion of the movable lid (13) can be a recess or a protrusion (26). In case it is a recess, the protrusion of the stationary cover (12) is designed to releasably fit into it, so as to releasably secure the movable lid (13) in the closed position. In case said portion of the movable lid is a protrusion (26) it is located below the protrusion of the stationary cover (12) when said movable lid (13) is in the closed position relatively to the stationary cover (12), as shown in FIG. 5.

Optionally but preferably, the movable lid (13) features a protruding secondary wall which is located inside the peripheral walls and cooperates with the groove (30) of the stationary cover (12) located along the periphery of the dispensing opening.

As shown in FIG. 2, one or more spring element(s) (15), preferably one, is attached in at least one point to the stationary cover (12) and in at least one other point to the movable lid (13), so that when the container is in the closed position, said spring element (15) is charged with a sufficient elastic energy to automatically open the movable lid (13) under the elasticity of said spring element (15), as soon as the locking mechanism (14) is released by the user. Said elastic energy can either be of the compression, torsion, or stretching type, but is preferably of the compression type. The spring element (15) is made of a material with excellent elastic properties, such as to allow efficient opening of the lid when the locking mechanism (14) is released, on a long period of use. The material must be such that it does not react with the lotion which impregnates the wipes, and specifically with the volatile ingredients which are released when the container (1) is opened during use. Such reactions, even minor would lead to loss of the material's spring properties, and the automatic opening feature of the container would be reduced or even stopped.

In one embodiment of the present invention, the spring element (15) is made out of a rubber-like elastic material, which can be either based on natural or synthetic rubber. In another embodiment of the invention, the spring element (15) is made out of a metal-based material. In both of the preceding embodiments, the shape of the spring element (15) is any shape suitable for achieving excellent spring properties, while being easy and cheap to manufacture. For example, the spring element (15) can have the shape of a flat blade which is located between the movable lid (13) and the stationary cover (12), and which is bent between these two parts when the movable lid (13) is in the closed position and thus charged with elastic energy.

In a second and preferred embodiment of the present invention, and as shown in FIG. 2, the spring element (15) is a high grade stainless steel single or multiple winding coil spring with two elongated ends. The high grade stainless steel resists corrosion, it ensures a long-term constant efficiency of the spring, while being cheaper than synthetic rubber springs to manufacture. It is fixed at its one end to the attaching means of the stationary cover (12), while its other end is fixed to the attaching means of the movable lid (13), such that once fixed between these two parts, it is charged with an elastic energy when the lid is in the closed position. More preferably, in the case the spring element (15) is a metallic spring, it is placed in a locating seat which is separates it from the contents especially during the dispensing operation. Preferably, the locating seat is not only a recess into which the spring element (15) is located, but it is also covered by a part, such that the spring's ends are free to move, but the center part of the spring element (15) is not accessible. The reasons for this are: firstly when dispensing a wipe, one part of the spring element may damage or tear the wipe, and secondly the locating seat prevents access to the spring element (15), especially by children, and thus accidental removal.

In any of the two preceding embodiments of the present invention, the spring element (15) is integrated to at least the movable lid (13) or the stationary cover (12). In the case the spring element (15) is a rubber-like material it is preferably co-molded, via a multi-injection molding process or the like, together with the movable lid (13) and/or the stationary cover (12). In the case the spring element (15) is made of a metallic material, it is bonded to the stationary cover (12) and/or the movable lid (13) by a heat stacking process, an ultrasonic welding process or any other similar and suitable process.

Optionally but preferably in any of the preceding embodiments, the spring element (15) can be colored to match the color of the stationary cover (12) and the movable lid (13).

As shown in FIGS. 1 and 5, a releasable locking mechanism (14) is achieved by at least one protrusion (25), for example a catch of the stationary cover (12) which fits with one or more, preferably one corresponding protrusion (26) or recess of the movable lid (13).

In one embodiment of this invention, the releasable locking mechanism (14) is directly released by displacing a separate movable element of the stationary cover (12), for example a bascule push-button (27), onto which said protrusion of the stationary cover (25) is connected, thus disengaging said protrusion (25) of the stationary cover from said recess or protrusion (26) of the movable lid.

In another and preferred embodiment of the invention, and as shown in FIG. 5, the releasable locking mechanism (14) is indirectly released when the user applies an elastic deformation onto an area of the stationary cover (12) which is located close enough to said releasable locking mechanism (14), thus disengaging said protrusion (25) of the stationary cover (12) from said recess or protrusion (26) of the movable lid (13). Said deformable area constitutes a push-button (27) means which has preferably the form of a recessed portion of the stationary cover (12), located between the front edge of said stationary cover (12), and the front edge of the dispensing opening (as shown in FIGS. 1 and 5). Said elastic deformation should be achievable with only a limited applied strength such as to allow to use a single finger to release the releasable locking mechanism (14).

As previously described, the container contents is preferably wipes wetted with a disinfectant lotion, said lotion comprising volatile components in its composition, such as alcohol. Thus, to prevent that the wipes dry out once the flexible pouch has been opened, the container (1) is provided with a gas-tight means (16) which is positioned between the stationary cover (12) and the movable lid (13).

A structural gas-tightness is achieved between the stationary cover (12) and the container body (11) by the special construction of the connecting surfaces between these two parts. More specifically, the design of the container body's flange, and the design of the stationary cover's peripheral walls are such that these two parts are fitted to each other in a very tight manner and interconnected. In that way, once the container body (11) is closed by the stationary cover (12), the vapor transmission between the two is decreased to a value sufficiently low to prevent evaporation of the lotion volatile components, and to prevent that the lotion overall composition be substantially modified over the normal period of storage and use of the wipes. Such a construction is not possible for the surfaces between the stationary cover (12) and the movable lid (13) because the lid must be automatically opened by the elastic energy contained in the spring element (15), when the releasable locking mechanism (14) is released. Said elastic energy is sufficient to carry the weight of the movable lid (13) from an horizontal (i.e. closed) position to a wide open position (i.e. opening angle comprised within the range of 35 to 180°, preferably between 90 and 135°). However it is not sufficient to exert a force to extract the lid from the cover if the contact surfaces between the two are interconnectedly and tightly maintained to each other.

A solution provided in the preferred embodiment of the present invention, to allow excellent gas-tight properties of the container—compatible with the highly volatile nature of the lotion contained inside—while keeping the benefit of the automatic opening, is to have a gasket seal (16) positioned all around the dispensing opening (23) of the stationary cover (12), preferably into a groove (30). The gasket seal (16) can have any cross-section shape, for example it can be annular, but it is preferably shaped like a meniscus such that its top part comprises a central groove-like portion, as shown in the cross sectional view in FIG. 5. While it can be out of any suitable material with good elastic properties and resistance to volatile solvents, it is preferably made out of a rubber-based material. The gasket material can be of any density, for example it can be a foam-like material, but is preferably dense rubber. Most preferably it is a very flexible silicone elastomer.

In a preferred embodiment of this invention, the gasket seal (16) is obtained by mixing one or more liquid component(s) into the groove (30) of the stationary cover, and then cure them in place. More preferably, the gasket is obtained by mixing a curable liquid form organopolysiloxane and a liquid form silicon based cross-linker curing agent. Such technique is usually so-called as "flow-in" cure in place. The cure chemistry of the silicon gasket is a condensation reaction of OH-terminated poly-alkyl-siloxanes with functional poly-alkoxy-silanes. Most preferably a catalyst is used to facilitate the reactions. The basic reaction during the formation of the elastomer is between the terminate OH-group and the alkoxy-group. The desired gasket properties are achieved by a selective selection of the alkenyl or alkyl groups bonded to the Si atoms.

Application of the liquid components is preferably achieved by using a nozzle which moves above the groove (30) of the stationary cover, all around the periphery of the dispensing opening (23) and applies the liquid components of the gasket seal. When such a technique is used, no element of the stationary cover can be designed which would be protruding above the groove (30) because the passage for the liquid applying nozzle must be free all along said groove (30). For example, the releasable locking mechanism cannot comprise a protrusion of the stationary cover which fits into a recess of the movable lid: such a construction would require that said protrusion of the stationary cover would extend above the groove (30) which is not acceptable for the flow-in process.

In our preferred embodiment of the present invention, the gasket seal (16) is applied by flow-in, as previously described. This is the reason why the releasable locking mechanism (14) comprises a protrusion of the movable lid which is engaged under a corresponding protrusion of the stationary cover, when the tub is in the closed position. Such a construction is achieved by a protrusion of the stationary cover whose length is limited, such that it does protrude overt the groove (30). In this way, the nozzle which applies the liquid components of the gasket is free to move all along the groove's length.

Alternatively, the gasket seal (16) is applied as a preformed, solid, component which is fitted into the groove (30). When the movable lid (13) is locked in the closed position, at least one portion of said gasket seal (16) is compressed between the stationary cover (12) and said movable lid (13), as shown in FIG. 5, and all along its periphery. In this way, no volatile compounds can migrate from the inside of the container to the outside, and the wipes remain moistened with the lotion. More importantly, it is believed that such a system will allow to keep the proportions of lotion components substantially equal over the normal period of storage and use of a stack of wipes, thus keeping the cleaning and disinfectant properties of the wipes substantially the same all along the period of use of one stack of wipes.

The stationary cover (12), the movable lid (13), and the container body (11), are molded from a polypropylene material or any other suitable thermoplastic materials such as polyethylene, polystyrene, acrylonitryl butadiene styrene (ABS), polyester, polyvinyl chloride, polycarbonate or elastomer, or a blend of these compounds. Preferably, the stationary cover (12) and the container body (11) are made out of a polypropylene, and the movable lid (13) is made out of an acrylonitrile-butadiene-styrene resin (or ABS). ABS resin provides the movable lid (13) with high solidity and resistance to flexion, as well as excellent resistance to solvents, especially volatile solvents which could be comprised within the composition of a lotion for impregnating cleaning wipes.

Optionally, in any of the preceding versions of the present invention, in which the closing device (10) is a separate element that fits onto the container body (11), said container body (11) comprises an upper opening, with a external peripheral upper edge and a flange which shall extend therefrom; the internal surfaces of this upper opening comprise ribs and/or grooves that extend along the periphery of the container body (11). Said ribs and/or grooves fit into corresponding ribs and/or grooves of the stationary cover (12) in such a way that no step nor overlap results from the assembling, and the surface of the package especially on its top part is regular and does not include sharp edges. Still, on one face of the package, preferably one of the small sides, the container may include an opening tab overlapping the external peripheral upper edge of the container body (11), said overlap having a dimension of less than 5 mm, preferably less than 3 mm, and said opening tab preferably having an arcuate shape, so that it is not aggressive for the consumer's fingers. Said overlap shall be used as a grabbing means to remove the stationary cover (12) from the container body (11) when refilling it with a new pouch of wipes.

What is claimed is:

1. A container for wetted wipes, comprising a container body, a stationary cover being removably fitted on, or integrated to said container body, said stationary cover comprising at least one dispending opening through which the container contents is removable, a movable lid which is movably attached to said stationary cover, so as to reversibly close said dispensing opening, a locking mechanism located between the stationary cover and the movable lid for releasably securing the movable lid in the closed position onto the stationary cover, the locking mechanism comprising a protrusion of the stationary cover which engages against a corresponding protrusion of the movable lid, and a push-button, a gas-proof means which is located between said stationary cover and said movable lid, for providing a gas-tight barrier between the inside and the outside of the container when the movable lid is in the closed position, wherein the gas proof means comprises a gasket seal said gasket seal being a preformed element fitted into a groove of the stationary cover.

2. A container according to claim 1, wherein a spring element is located between said stationary cover and said movable lid, and is charged with an elastic energy when the movable lid is in closed position.

3. A container according to claim 1, wherein a pushbutton is an elastically deformable portion of the stationary cover, said push-button being located near enough to the protrusions of the stationary cover and the movable lid, to disengage said protrusion of the movable lid from said protrusion of the stationary cover when said pushbutton is pressed, thus releasing the movable lid into the open position.

4. A container according to claim 1, further comprising a spring element, wherein the spring element is a metallic single or multiple winding coil spring with elongated ends.

5. A container according to claim 1, further comprising a spring element, wherein the spring element is made out of a synthetic or natural rubber-like material.

6. A container according to claim 1, wherein the gas-proof means is a gasket seal which is located along the periphery of the dispensing opening.

7. A container according to claim 1, wherein the gasket seal is made out of a silicone elastomer.

8. A container according to claim 1, wherein the gasket seal is applied as one or several liquid components which are mixed and then cured in place.

9. A container according to claim 1, wherein the gasket seal is substantially compressed all along its periphery when the movable lid is in the closed position.

10. A container according to claim 1, wherein the stationary cover comprises ribs and grooves which fit into corresponding ribs and grooves of the container body, said stationary cover being adjustably attached to said container body so that the resulting assembling surfaces are edgeless.

11. A container according to claim 9, wherein the stationary cover is an integral part of the top side of the container body, the bottom side of the container body comprising a refill opening which is closed by a removable cover.

12. A container according to claim 1, which is to be used for disinfectant wipes which are folded for removal one by one from the container.

* * * * *

UNITED STATES PATENT AND TRADEMARK OFFICE

CERTIFICATE OF CORRECTION

PATENT NO. : 6,902,077 B1
DATED : June 7, 2005
INVENTOR(S) : Joris Jozef Gustaaf Tack et al.

It is certified that error appears in the above-identified patent and that said Letters Patent is hereby corrected as shown below:

Column 3,
Line 40, delete “thanol” and insert therefor -- ethanol --.

Column 4,
Line 51, delete “th se” and insert therefor -- these --.

Column 10,
Line 23, delete “dispending” and insert therefor -- dispensing --.

Signed and Sealed this

Fourth Day of October, 2005

JON W. DUDAS
*Director of the United States Patent and Trademark Office*